United States Patent [19]

Holliday

[11] Patent Number: 4,863,062

[45] Date of Patent: Sep. 5, 1989

[54] CONTAINER HAVING HINGEDLY MOUNTED ARMS

[75] Inventor: Hubert J. Holliday, Edlesborough, England

[73] Assignee: Perstorp AB, Perstorp, Sweden

[21] Appl. No.: 72,399

[22] Filed: Jul. 13, 1987

[30] Foreign Application Priority Data

Jul. 15, 1986 [GB] United Kingdom ..... 8617196

[51] Int. Cl.[4] ..... B65D 51/04

[52] U.S. Cl. ..... 220/338; 16/257; 16/262

[58] Field of Search ..... 16/257, 259, 229, 262, 16/270, 271, 272, 382, 383; 220/337, 338, 340, 342

[56] References Cited

U.S. PATENT DOCUMENTS

| | | | |
|---|---|---|---|
| 2,474,311 | 6/1949 | Graham | 16/257 X |
| 3,962,750 | 6/1976 | Buss et al. | 220/342 X |
| 4,216,862 | 8/1980 | Daenen | 220/337 X |
| 4,302,866 | 12/1981 | Irvin | 220/337 X |
| 4,466,541 | 8/1984 | Tabler et al. | 220/338 X |
| 4,684,017 | 8/1987 | Watanabe et al. | 220/342 X |

FOREIGN PATENT DOCUMENTS

| | | | |
|---|---|---|---|
| 1190491 | 3/1959 | France | 16/382 |
| 2333925 | 7/1977 | France | 16/270 |
| 2141778A | 1/1985 | United Kingdom | 16/229 |

*Primary Examiner*—Nicholas P. Godici
*Assistant Examiner*—J. Reed Batten, Jr.
*Attorney, Agent, or Firm*—Stevens, Davis, Miller & Mosher

[57] ABSTRACT

A hinge arrangement for a container is provided, which includes a first member defining a plurality of spaced apart knuckles and a second member defining a knuckle to be located between two adjacent knuckles on the first member. The knuckles on the first member and the knuckle on the second member define an inter-engaging unit to enable the knuckles to be pivotally connected together. The second member also defines a structure for releasably connecting the knuckle carried thereby to the container to which the first member is to be hingedly connected.

4 Claims, 3 Drawing Sheets

CONTAINER HAVING HINGEDLY MOUNTED ARMS

DESCRIPTION OF INVENTION

The present invention relates to a hinge arrangement, and more particularly to a hinge arrangement for a nestable and stackable container. In particular the present invention relates to a hinge arrangement for a nestable or stackable container of generally rectangular form having, at two opposed ends, a hingedly mounted flaps or bail arms. The flaps or bail arms may be hinged inwardly to enable a similar container to be stacked on top of the container in question, or the flaps or bail arms may be moved pivotally outwardly to permit the containers to be stacked.

Containers of this type have been fabricated previously, and have been fabricated totally of a plastics material. However, when designing such containers care has to be taken to ensure that the hinge arrangement operates in a satisfactory manner, and that the components can be interconnected in an appropriate manner.

Previous attempts to provide containers of this type have thus involved the provision of hinges including interleaved knuckles, some knuckles being on the container and some knuckles being on the bail arm. The knuckles have been provided with cooperating projections and recesses. The knuckles having the projections and recesses must be moulded with very high tolerance, involving the use of relatively expensive tools, and thus the tools for making the containers and the tools for making the bail arms have been expensive.

The present invention seeks to reduce or obviate this disadvantage of the prior art.

According to one aspect of this invention there is provided a hinge arrangement, said hinge arrangement comprising a first member defining a plurality of spaced apart knuckles, and a second member defining a knuckle to be located between two adjacent knuckles ono the first member, the knuckles on the first member and the knuckle on the second member defining inter-engaging means to enable the knuckles to be pivotally connected together, the second member additionally defining means by which the knuckle carried thereby can be releasably connected to a component to which the first member is to be hingedly connected.

Preferably the second member comprises a knuckle and at least one connecting blade, the connecting blade being insertable into and retainable within an aperture or recess formed in the said component.

Conveniently the knuckles on the first member are each provided with projections directed towards the next-adjacent knuckle across the spaced defined therebetween, and the knuckle provided on the second member is provided with recesses which receive the said projections.

Advantageously the first member defines at least three spaced apart knuckles and wherein there are a plurality of second members and associated knuckles, the knuckles on the second members each being located between a respective pair of spaced apart knuckles on the first member.

Preferably the inter-engaging means provided on the knuckles of the first member and the knuckle of the or each second member comprise projections and recesses, each knuckle being provided either with projections or with recesses, the said knuckles being interengaged while at least one of said first member and said second member, which is formed of a plastic material, is hot and readily deformable.

Conveniently the first member is in the form of an arm to be pivotally connected to a container, the first member being interconnected with a plurality of second member while the first member, which is of plastic material, is in a hot deformable condition.

Preferably the or each second member is connected to a wall of a container so that the first member is pivotally mounted on the container in such a position that it can be pivoted into a position in which it partly closes the open mouth of the container and it can also be pivoted into a position in which it does not obstruct the open mouth of the container.

According to another aspect of this invention there is provided a container provided with two hingedly mounted arms, mounted at the top of two opposed side walls of the container, the arms being hingedly mounted in position by means of a hinge arrangement according said one aspect.

According to a further aspect of this invention there is provided a hinge arrangement, said hinge arrangement comprising a first member defining a plurality of spaced apart knuckles, and at least one second member defining a knuckle to be located between two adjacent knuckles on the first member, the knuckles on the first member and the second member defining inter-engaging means to enable the knuckles to be pivotally connected together, said inter-engaging means being constituted by projections and recesses, each knuckle carrying either one or more projections or carrying one or more recesses, the projections and the recesses being interengaged to constitute a pivotal connection between said members while either the first member, or the second member, being fabricated of a plastics material, is warm and thus readily deformable.

Preferably the or each second member is provided with means by which the second member can be releasably connected to an element on which the first member is to be pivotally mounted.

According to another aspect of this invention there is provided a container provided with two hingedly mounted arms, mounted at the top of two opposed side walls of the container, the arms being hingedly mounted in position by means of a hinge arrangement.

In order that the invention may be more readily understood, and so that further features thereof may be appreciated, the invention will now be described by way of example with reference to the accompanying drawings in which.

Figure 1:
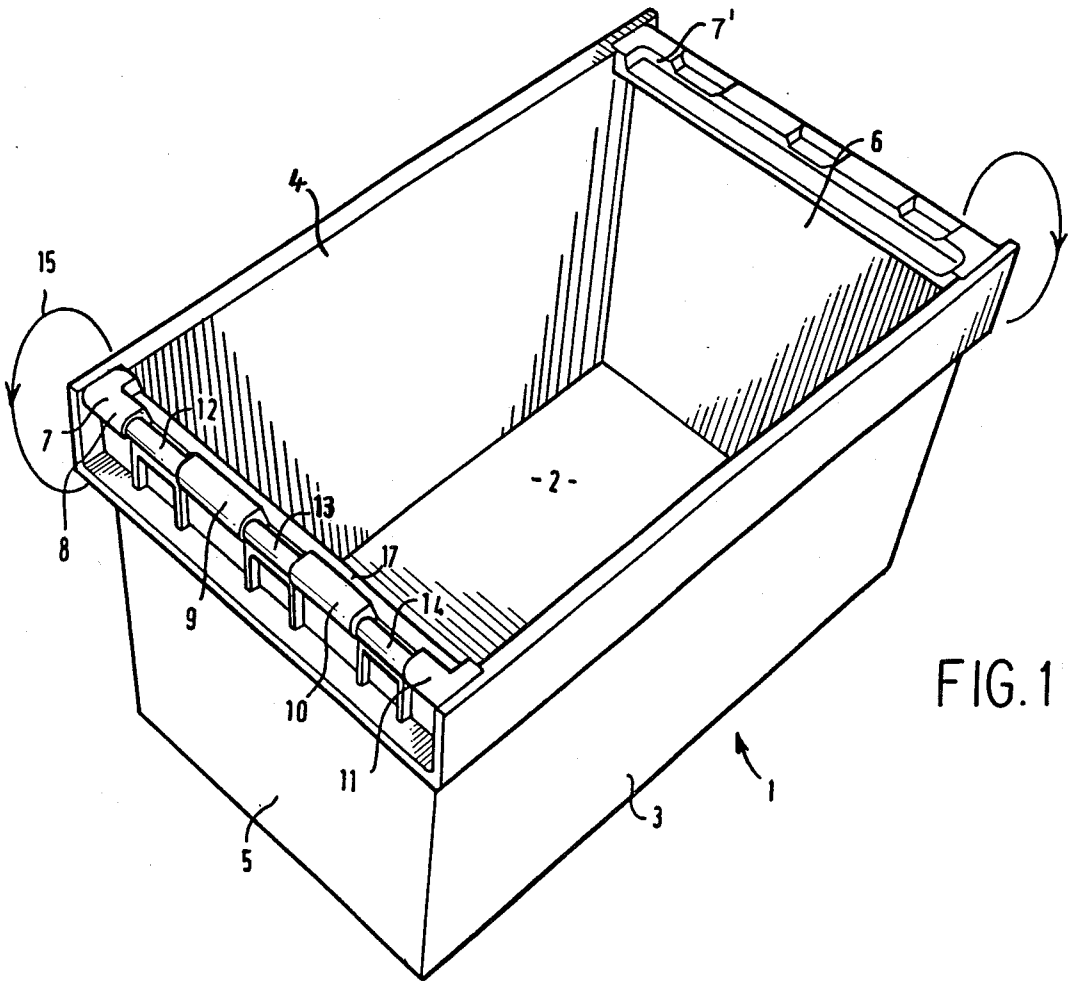
FIG. 1 is a perspective view of a typical container with a hinge arrangement in accordance with the invention.

Referring initially to FIG. 1 of the accompanying drawings a container in accordance with the invention is a generally rectangular container 1 having a base 2, two relative long opposed side walls 3, 4 and two opposed relatively short end walls 5, 6. The container may be fabricated by injection moulding of each of the components of the container any appropriate plastics material.

Provided on the container, in the region of the top of each of the short end walls 5, 6 is a respective hinged flap or bail arm 7 or 7'. The bail arms 7 and 7' are identical and thus only one bail arm will be described in detail. The precise manner of the hinged connection between the bail arm and the container will be described in more detail hereinafter, but it is to be noted that the bail arm 7 is provided with a plurality of knuckles 8, 9, 10 and 11 which are interleaved with corresponding knuckles 12, 13 and 14 which are mounted on the container. It will be understood that the bail arm 7 may be hinged to an inner position, as illustrated in FIG. 1, when a similar container is to be stacked on top of the container, or may be hinged to an outer position, by turning the bail arm in the direction indicated by the arrow 15, when the container is to be nested with another similar container.

Figure 2:
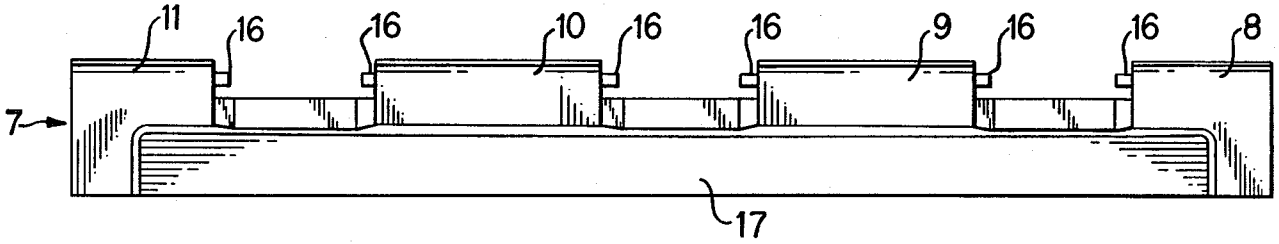
FIG. 2 is a top plan view of a bail arm of the container shown in FIG. 1.

As shown in FIG. 2 the bail arm 7 is provided with knuckles 8, 9, 10 and 11 which are moulded integrally with the bail arm. Spaces are defined between the adjacent knuckles, and on the end walls of the knuckles directed towards the spaces are cylindrical projecting spigots. The main body portion of the bail arm defines a recess 17 adapted snugly to receive part of the base of a corresponding container. When the containers are to be stacked. It will be understood that the bail arm may be manufactured in a two-part mould. The bail arm must be moulded to a relatively close tolerance, but the tool necessary to mould the bail arm is only relatively small and thus not very expensive.

Figure 3:
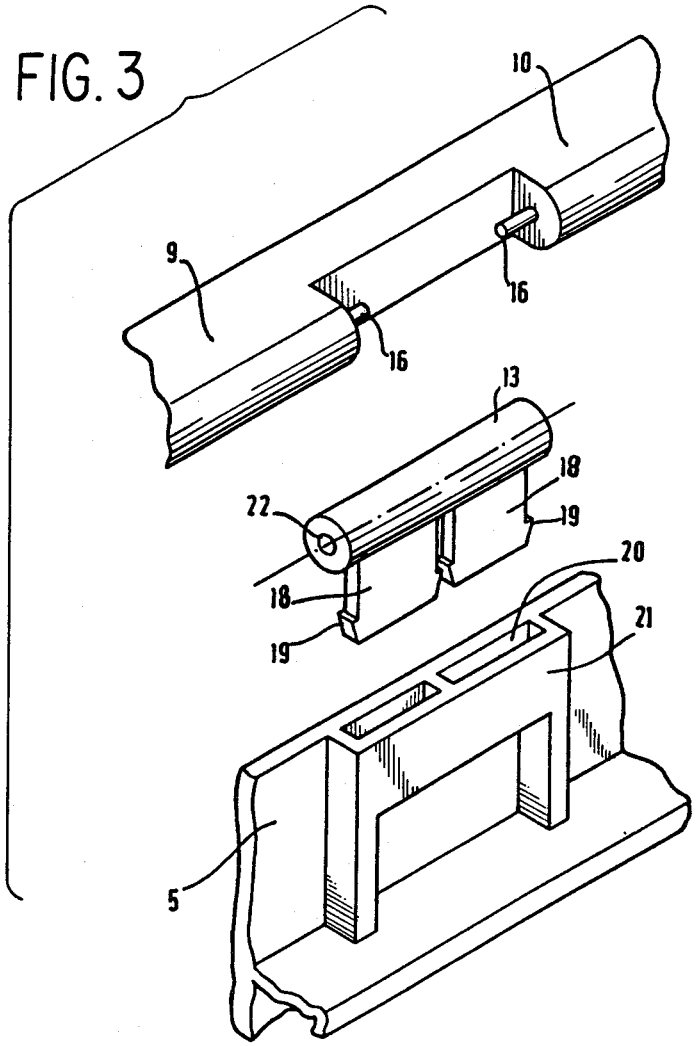
FIG. 3 is an exploded view showing part of the bail arm illustrated in FIG. 2, a connecting element carrying a knuckle, and part of the container.

Referring now to FIG. 3 of the accompanying drawings part of the bail arm between the knuckles 9 and 10 is illustrated. The cylindrical projecting spigots 16 can be seen. In FIG. 3, which is an exploded view, the intermediate knuckle 13 which is mounted on the container is also illustrated, and it can be seen that this knuckle forms an integral part of an element having two projecting blades 18 with associated locking tangs 19, which is to be mounted on the container. The element is adapted to have the blades thereof inserted into apertures 20 formed in a projecting housing 21 formed at the top of the end wall 5 of the container, with the locking tangs engaging the apertures to retain the element in position.

The knuckle 13 is provided with two cylindrical recesses 22 in the end walls thereof, dimensioned to receive the projecting spigots 16.

The remaining knuckles 12, and 14 mounted on the container are of the same design as the knuckle 13.

In assembling the described container when the flap or bail arm has just been moulded, and is still in a hot, and therefore flexible condition, pre-moulded elements incorporating the knuckles 12, 13 and 14, all having a design as illustrated in FIG. 3, are manipulated so that the cylindrical holes 22 formed in the knuckles are engaged with the projecting spigots 16. This can be accomplished while the bail arm is in a warm and flexible condition without undue difficulty. Thus the knuckles 12, 13 and 14 are connected to the bail arm. When the bail arm has cooled, the knuckles 12, 13 and 14 cannot be removed from the bail arm, but the projecting blades 18 may be inserted through the apertures such as the aperture 20 formed in the end wall of the container, and when all the knuckle-carrying elements have been mounted in position in this manner the bail arm is securely mounted on the container but can move hingedly in the desired manner.

If the bail arm becomes damaged, or if the bail arm is to be removed for cleaning purposes, by appropriately manipulating the locking tangs 19 on the blades 18 the elements carrying the knuckles 12, 13 and 14 may be removed from the container.

It will be understood that the dimensions of the aperture 20 need not be moulded to a very high tolerance. Thus it is possible to mould the main body of the container 1 in a relatively low cost tool, since nowhere in the container is a very high degree of tolerance required. Thus a cheap tool may be used to mould the container. The connecting elements carrying the knuckles 12, 13 and 14 must be moulded to a relatively high degree of tolerance, but these components can be moulded using a small two-part tool with two retractable pins. Thus again the tool need not be very expensive.

Whilst the described container has flaps mounted on the relatively short end walls, in an alternative embodiment the flaps may be on the relatively long side walls. Each hinge may comprise any suitable number of knuckles, and the knuckles may be of uniform length or differing lengths. All the separate components may be made of the same or different materials. The relatively small components, such as the intermediate knuckles and the bail arms, may be made of relatively expensive plastic material, such as polycarbonate or nylon materials, without a significant cost penalty. Thus appropriate materials may be selected for appropriate requirements. Appropriate materials may thus be selected for the component which is to be hot and flexible when the hinge components are assembled together to ensure that the clip is assembled satisfactorily. The bail arms and the intermediate knuckles may be of different colours to that of the main container, and these colours may provide a colour code to indicate the end usage of acceptable environmental conditions for use of the container.

Thus, in summary, the invention provides a new design of hinge arrangement which can be used is stackable container provided with flaps or bail arms which can be fabricated from components moulded on relatively cheap tools, and in which the bail arm may readily be removed from the container should such action be necessary for cleaning or maintenance purposes. The hinge may be assembled more easily than many prior proposed hinges.

I claim:

1. A container, comprising two opposed side walls and a pair of arms hingedly mounted at the top of said side walls by means of a hinge arrangement comprising a plurality of spaced apart first knuckles on each of said arms and a member defining a second knuckle to be located between two adjacent first knuckles on each of the arms, the first knuckles on the arms and the second knuckle on said member defining inter-engaging means for enabling the first knuckles and the second knuckle to be pivotally connected together, said member additionally defining at least one integral male member being insertable into and retainable within an aperture or recess formed at the top of the side wall of the container for releasably connecting the second knuckle carried thereby to the container.

2. A container according to claim 1, wherein said integral male member comprises a connecting blade.

3. A container according to claim 2, wherein the connecting blade is provided with locking tangs for locking said blade within said aperture or recess.

4. A container according to claim 16, wherein said inter-engaging means comprises projections and recesses, each one of said first knuckles and said second knuckle carrying either one or more said projections or carrying one or more said recesses, the projections and the recesses being inter-engaged to constitute a pivotal connection between said first knuckles and said second knuckle while one of (i) the first knuckles and (ii) the second member, being fabricated of a plastics material, is warm and thus readily deformable.

* * * * *